US007414644B2

(12) United States Patent
Yamagata

(10) Patent No.: US 7,414,644 B2
(45) Date of Patent: Aug. 19, 2008

(54) IMAGE FORMING DEVICE

(75) Inventor: Takashi Yamagata, Otsu (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 42 days.

(21) Appl. No.: 11/559,789

(22) Filed: Nov. 14, 2006

(65) Prior Publication Data

US 2007/0070172 A1 Mar. 29, 2007

Related U.S. Application Data

(62) Division of application No. 10/993,320, filed on Nov. 19, 2004, now Pat. No. 7,245,313.

(30) Foreign Application Priority Data

Dec. 16, 2003 (JP) ..... 2003-417543

(51) Int. Cl.
*B41J 15/14* (2006.01)
*B41J 27/00* (2006.01)

(52) U.S. Cl. ..... 347/242; 347/257

(58) Field of Classification Search ..... 347/130, 347/149, 241, 242, 244, 256–258; 399/46, 399/102, 118, 300
See application file for complete search history.

(56) References Cited

U.S. PATENT DOCUMENTS 4,538,896 A * 9/1985 Tajima et al. ..... 399/102
5,089,846 A 2/1992 Tabuchi
5,189,477 A * 2/1993 Leys et al. ..... 399/300
5,477,306 A * 12/1995 Iguchi et al. ..... 399/46
5,808,718 A * 9/1998 Aikoh et al. ..... 347/130
6,801,232 B2 * 10/2004 Nagamine et al. ..... 347/149
6,836,631 B2 * 12/2004 Mogi ..... 399/118

FOREIGN PATENT DOCUMENTS

JP 62149051 A 9/1987
JP 63148954 A 9/1988
JP 04096082 A 3/1992

(Continued)

OTHER PUBLICATIONS

Japanese language office action and its English translation for corresponding Japanese application 2003-417543 lists the references above.

*Primary Examiner*—Hai C Pham
(74) *Attorney, Agent, or Firm*—Hogan & Hartson LLP

(57) ABSTRACT

An image forming device includes a main frame having a body and a photoconductive drum which is provided removably in the main frame. An optical writing head is provided which is positioned relatively with respect to the photoconductive drum and includes a lens array at an output side of the optical writing head. A housing of a photoconductive drum unit is provided which rotatably supports the photoconductive drum and is positioned and supported on the body of the main frame. By contacting the lens array directly against a surface of the housing of the photoconductive drum unit, the optical writing head is positioned relatively with respect to the photoconductive drum. A shock absorbing member is provided between the lens array and a contact part where the lens array makes contact with the surface of the housing of the photoconductive drum unit.

6 Claims, 6 Drawing Sheets

FOREIGN PATENT DOCUMENTS

| | | | | |
|---|---|---|---|---|
| JP | 05-127464 | | | 5/1993 |
| JP | 05113712 | A | | 5/1993 |
| JP | 05241386 | A | | 9/1993 |
| JP | 05289477 | A | * | 11/1993 |
| JP | 06-102742 | | | 4/1994 |
| JP | 06130746 | A | | 5/1994 |
| JP | 06166209 | A | | 6/1994 |
| JP | 06206337 | A | | 7/1994 |
| JP | 08142445 | A | | 6/1996 |
| JP | 09095013 | A | | 4/1997 |
| JP | 09-319173 | | | 12/1997 |
| JP | 10-016294 | | | 1/1998 |
| JP | 10119345 | A | * | 5/1998 |
| JP | 11-065400 | | | 3/1999 |
| JP | 2002023593 | A | * | 1/2002 |
| JP | 2002-091268 | | | 3/2002 |

* cited by examiner

IMAGE FORMING DEVICE

RELATED APPLICATIONS

This is a divisional of application Ser. No. 10/993,320 filed on Nov. 19, 2004, which claims priority under 35 USC 119 in Japanese Patent Application No. 2003-417543, filed on Dec. 12, 2003, which applications are incorporated by reference in their entireties.

BACKGROUND OF THE INVENTION

1. Field of the Invention

The present invention relates to an image forming device having an electrophotographic printing device of a facsimile machine, a copy machine or a printer (including a Multi Functional Peripheral (MFP) of these machines) or the like. In particular, the present invention relates to a structure for relatively positioning an optical writing head, which writes optical image information on a uniformly charged surface of a photoconductive drum and forms an electrostatic latent image, with respect to the photoconductive drum.

2. Description of Related Art

In the electrophotographic printing device, a photoconductive drum is embedded in a drum unit (a drum cartridge) or a process unit (a process cartridge) which also includes a developing unit. The photoconductive drum is positioned in a main frame of an image forming device via these units. With respect to these units, an optical writing head (a light emitting element array) is positioned at a proper relative positional relationship with the photoconductive drum.

FIG. 6 shows an example of a conventional image forming device. A photoconductive drum 110 is supported rotatably on its axis in a unit housing 101. A photoconductive drum unit 100 including the unit housing 101 is provided at a prescribed position of a main frame of the image forming device. In the example shown in FIG. 6, an optical writing head 120 formed of a Light Emitting Diode (LED) is attached inside a maintenance cover 130 of the image forming device. When the cover 130 is closed, the photoconductive drum 110 and the optical writing head 120 are positioned relatively to one another. In the conventional example, a concave part 102 is formed on a surface of the housing 101. A positioning pin 121 is provided on the optical writing head 120. When the cover 130 is closed, the positioning pin 121 is received in the concave part 102. As a result, the optical writing head 120 is positioned to be located at a proper relative position with respect to the photoconductive drum 110.

In the example shown in FIG. 6, the photoconductive drum unit 100 includes the housing 101 formed of synthetic resins, a drum shaft 111 fixed on the housing 101 and the photoconductive drum 110 supported rotatably on the drum shaft 111. Furthermore, the photoconductive drum unit 100 includes a charger 103 and a toner cleaner 104 and is unitized. The photoconductive drum unit 100 is positioned at a prescribed position of the image forming device (not shown) by the drum shaft 111. When the cover 130 is closed, the positioning pin 121 is received in the concave part 102 formed on the surface of the housing 101. Consequently, the optical writing head 120 is positioned.

A positional relationship between the optical writing head 120 and the photoconductive drum 110 is influenced by the accuracy of the relative position of the photoconductive drum 110 and the drum shaft 111 and the accuracy of the relative position of the drum shaft 111 and the housing 101. Therefore, there are cases in which the accuracy of the positioning decreases. In particular, since the housing 101 is formed of synthetic resins, the measurement of the housing 101 is prone to be uneven. This fact is a great factor for decreasing the accuracy of the relative position of the optical writing head 120 and the photoconductive drum 110.

The above positioning is not based on a relative position with respect to the printing paper which is printed while being transported. Therefore, when a toner image on the surface of the photoconductive drum is transferred onto the paper, there are cases in which a prescribed transfer position on the paper is displaced. Furthermore, it is necessary to separately attach the positioning pin on a commercially available LED array. As a result, there is a drawback that a number of components and a number of assembling steps increase.

Therefore, there is a demand for an image forming device which can improve the accuracy of the relative position of the optical writing head and the photoconductive drum or which can reduce the number of components.

SUMMARY OF THE INVENTION

According to an aspect of the present invention, in an image forming device, an optical writing head is positioned relatively with respect to a photoconductive drum provided removably in a main frame of the image forming device. The optical writing head includes a positioning pin. The photoconductive drum is supported rotatably on a drum shaft. The drum shaft is positioned and supported on a body of the main frame of the image forming device. By contacting the positioning pin against a circumferential body of the drum shaft, the optical writing head is positioned relatively with respect to the photoconductive drum.

According to the present invention, by contacting the positioning pin against the circumferential body of the drum shaft positioned and supported on the body of the image forming device, the optical writing head is positioned relatively with respect to the photoconductive drum. A housing which is prone to generate a measurement error is not involved in the positioning. As a result, the accuracy of the positioning improves significantly.

According to another aspect of the present invention, in an image forming device, an optical writing head includes a positioning pin. A main frame of the image forming device includes a paper guide member. The paper guide member is fixed on a body in proximity to a part where a photoconductive drum is provided so that the paper guide member is located at a proper relative positional relationship with respect to the photoconductive drum. The positioning pin is caught in a positioned part of the paper guide member, and the optical writing head is positioned relatively with respect to the photoconductive drum.

According to the present invention, the positioning pin is caught in the positioned part of the paper guide member which is fixed on the body in proximity to the part where the photoconductive drum is provided so that the paper guide member is located at the proper relative position with respect to the photoconductive drum. Therefore, the optical writing head is maintained appropriately at a relative position with respect to paper which is printed while being transported. As a result, a toner image transferred onto the paper is less likely to be displaced.

According to another aspect of the present invention, an optical writing head includes a lens array at a light outputting side of the optical writing head. A photoconductive drum is supported rotatably on a housing of a photoconductive drum unit. By contacting the lens array directly against a surface of the housing of the photoconductive drum unit positioned on a body of a main frame of the image forming device, the optical writing head can be positioned relatively with respect to the photoconductive drum. In the present invention, a concave part having an outer shape approximately the same as an outer shape of the lens array is preferable to be formed on the surface of the housing making contact with the lens array.

According to the present invention, by contacting the lens array directly against the surface of the housing of the photoconductive drum unit, the optical writing head is positioned relatively with respect to the photoconductive drum. Therefore, components such as a positioning pin are not required to be provided newly, and a number of components and a number of assembling steps do not increase.

DETAILED DESCRIPTION OF THE INVENTION

Embodiments of the present invention will be described. Further, the embodiments to be described below are preferable specific examples for implementing the present invention. Therefore, there are various technical limitations in the description. However, unless explicitly stated in the following description to limit the present invention, the present invention shall not be limited to the embodiments.

Figure 1:
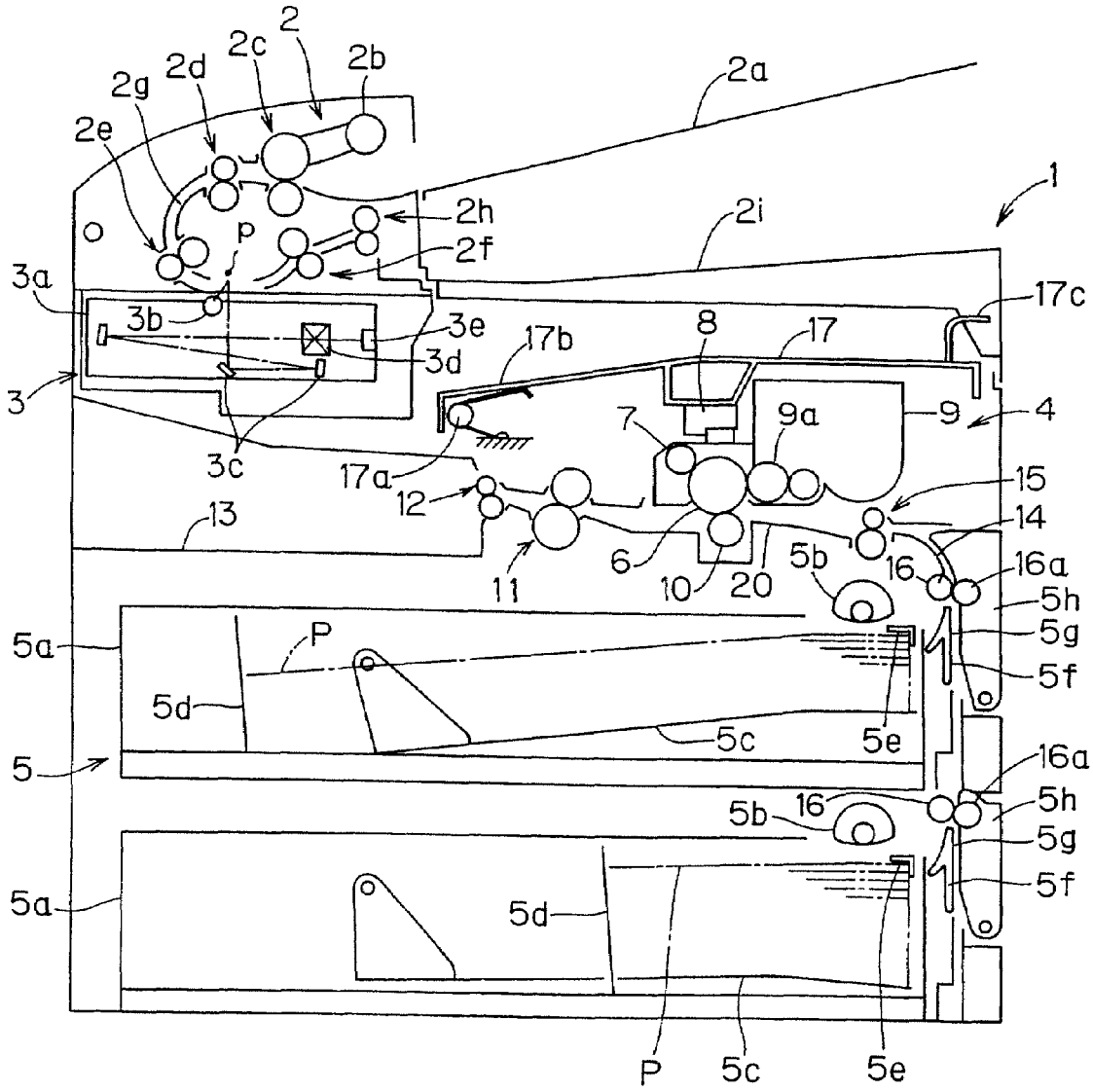
FIG. 1 is a longitudinal cross-sectional view showing an example of an image forming device according to an embodiment of the present invention.
Figure 2:
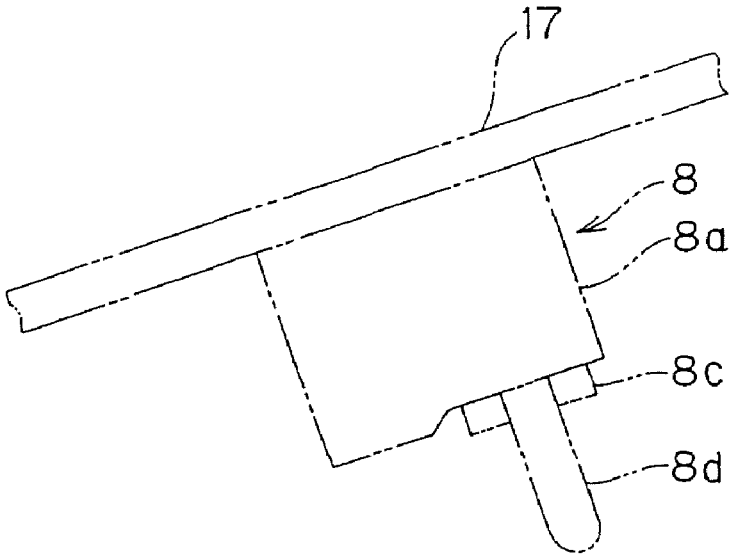
FIG. 2 is an enlarged front view of a positioning structure of an optical writing head.
Figure 2:
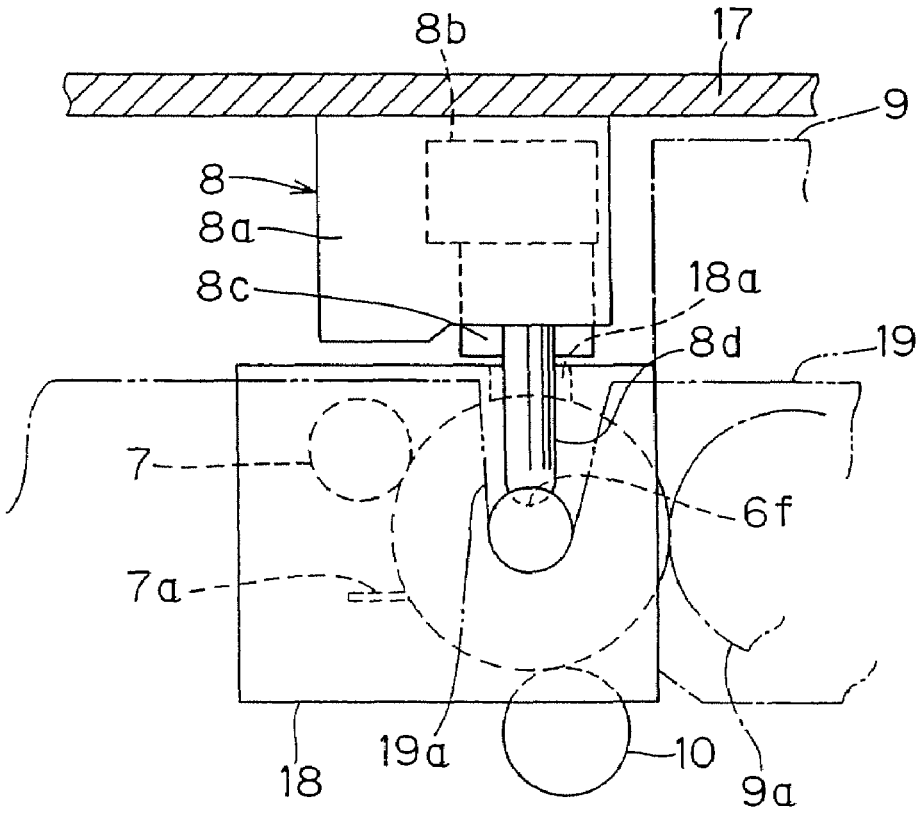
Figure 3:
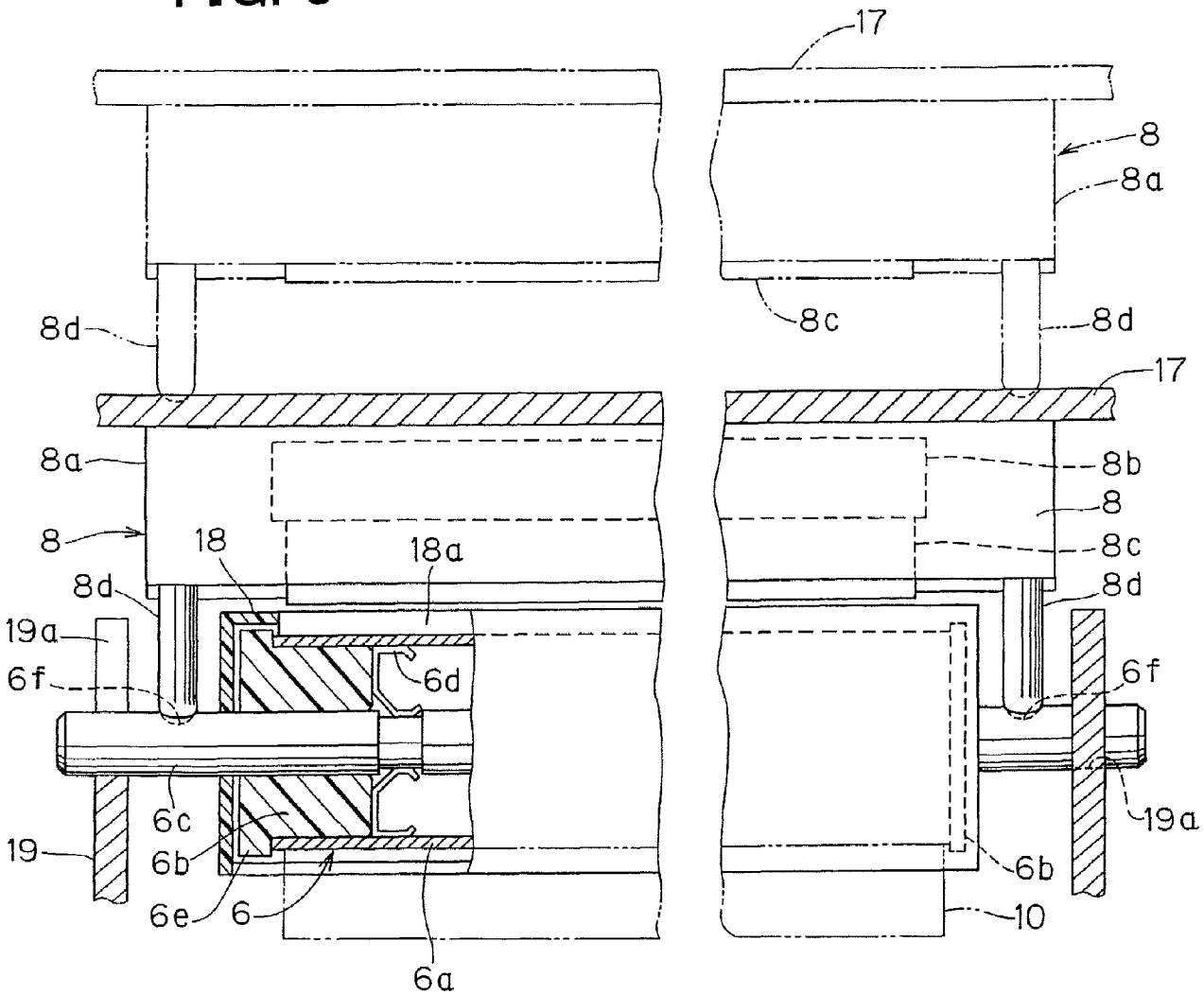
FIG. 3 is a side view of the positioning structure of the optical writing head.
Figure 4:
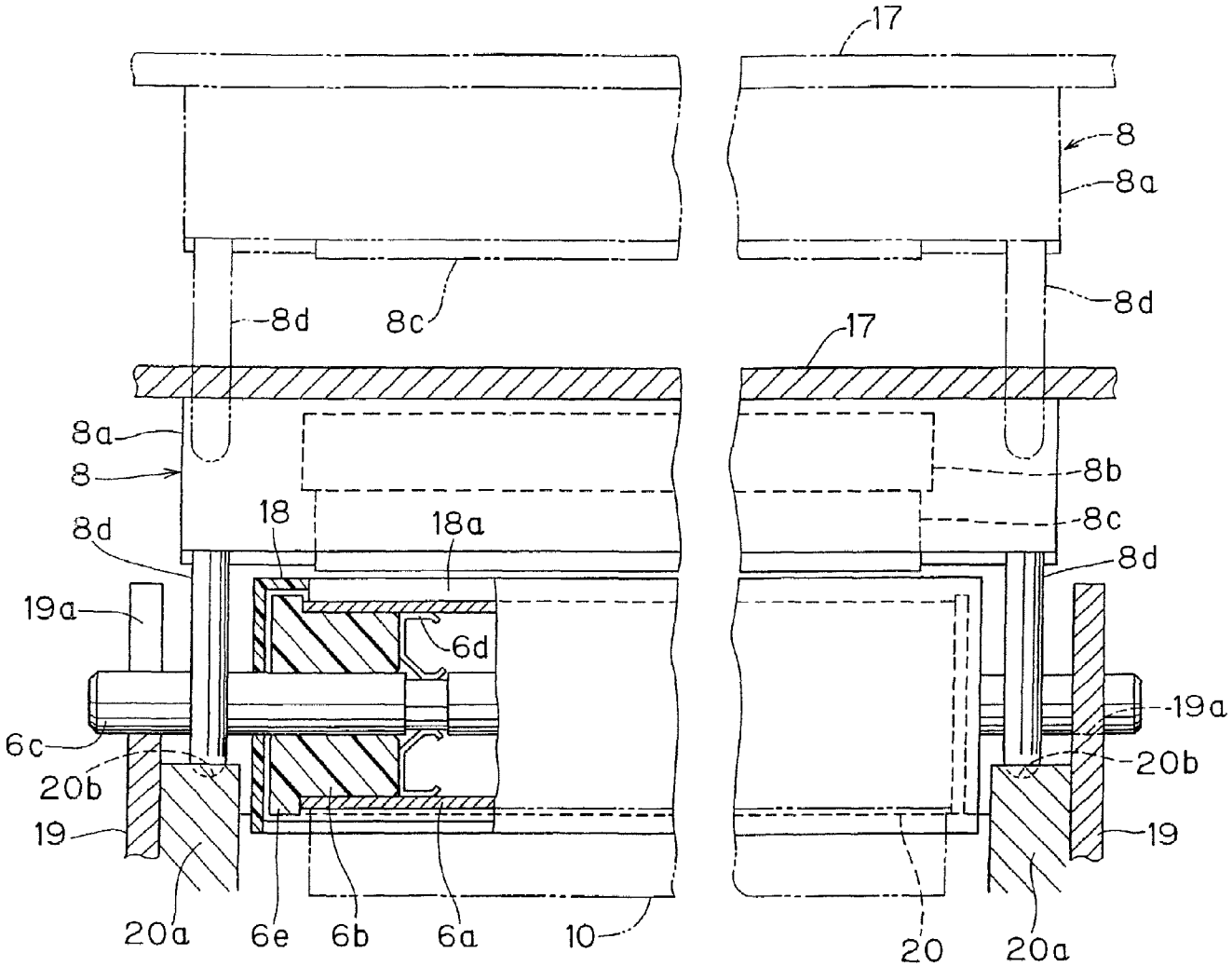
FIG. 4 is a side view of a positioning structure according to another embodiment of the present invention.
Figure 5:
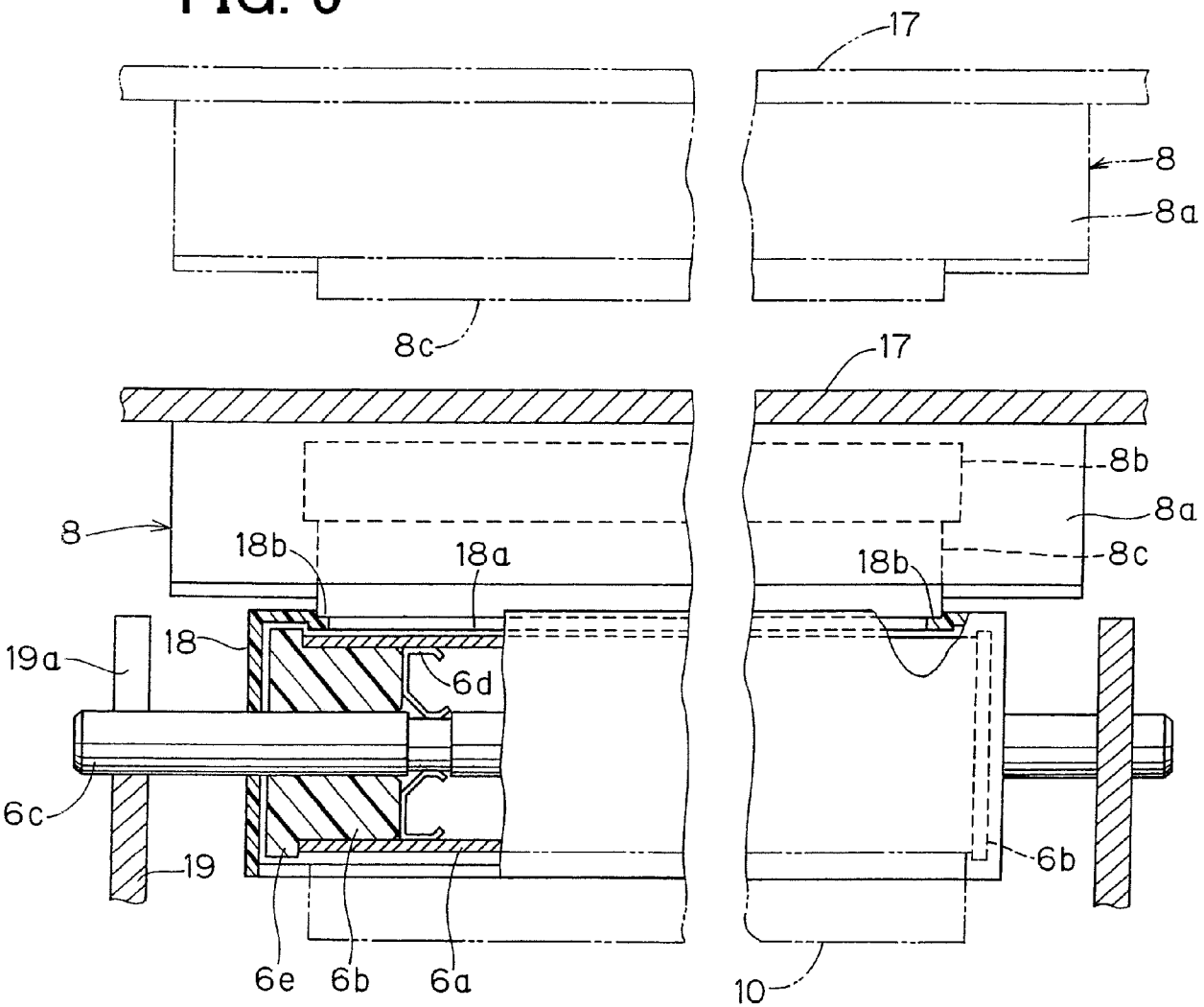
FIG. 5 is a side view of a positioning structure according to another embodiment of the present invention.
Figure 6:
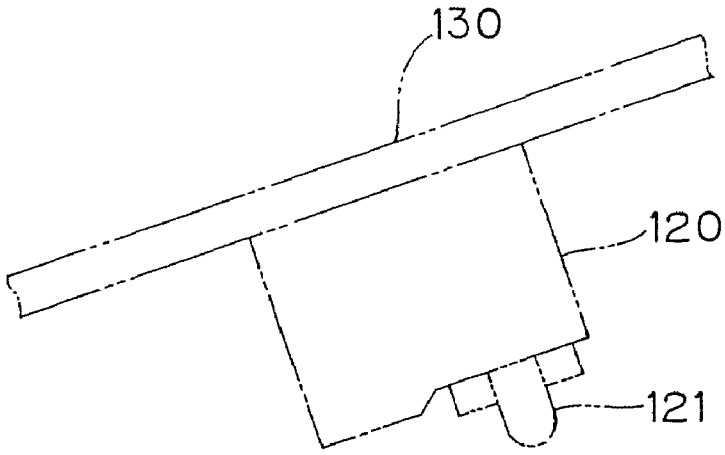
FIG. 6 PRIOR ART
FIG. 6 shows a conventional example.
Figure 6:
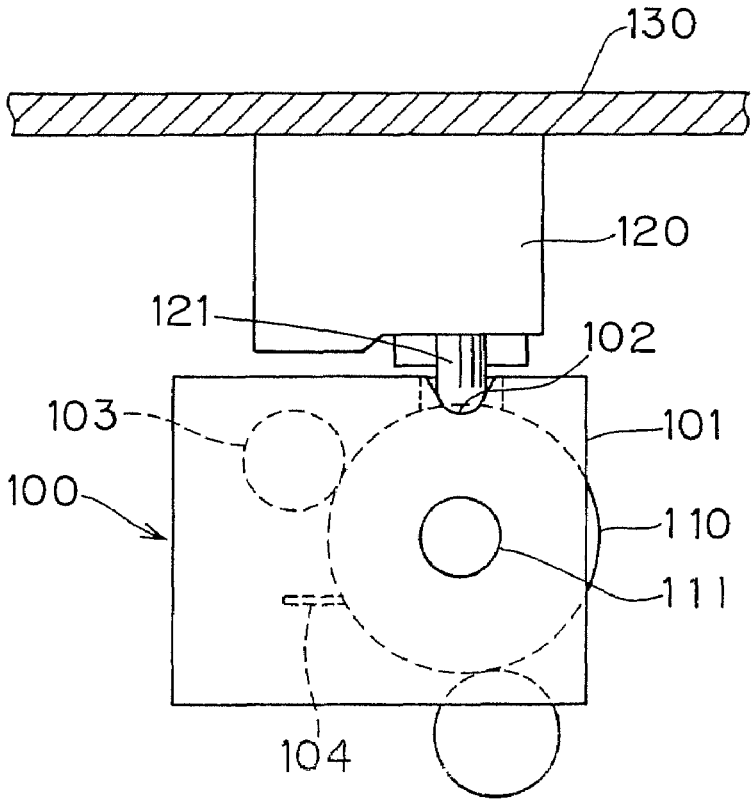
FIG. 6 PRIOR ART

FIG. 1 is a longitudinal cross-sectional view showing an example of an image forming device according to an embodiment of the present invention. FIG. 2 is an enlarged front view of a positioning structure of an optical writing head. FIG. 3 is a side view of the positioning structure of the optical writing head. FIGS. 4 and 5 are side views of the positioning structure of the optical writing head according to other embodiments of the present invention.

An image forming device 1 shown in FIG. 1 includes a facsimile function, a copy function and a printer function. The image forming device 1 is an MFP. The image forming device 1 is a device in which positioning structures of each of the embodiments of the present invention are applied in common. The image forming device 1 includes an Automatic Document Feeder (ADF) 2, an image scanning unit (a scanner device) 3, a printing unit 4 and a paper feed unit 5 storing recording papers, which are provided in a stacked state in this order from an upper side of the image forming device 1. In the ADF 2, original documents stacked on a document tray 2*a* are picked up and separated one sheet at a time by a pickup roller 2*b* and a separating means (a pair of a separating roller and a retard roller) 2*c*. The separated original document is transported by each pair of transportation rollers 2*d*, 2*e* and 2*f* through a curved transportation path 2*g*. At a document scanning point p of the ADF 2 located along the transportation path 2*g*, an image of the transported original document is scanned by the scanner device 3. Then, the original document is discharged sequentially onto a document discharge tray 2*i* by a pair of discharge rollers 2*h*. Further, as the separating means 2*c*, a separating roller and a separating pad are adopted in many cases. The ADF 2, the document tray 2*a* and the document discharge tray 2*i* are formed integrally and can be opened and closed vertically with a hinge (not shown) at an inner side of the page of FIG. 1 as a swing center. An upper surface of the image scanning unit 3 and the printing unit 4 can be opened.

The scanner device 3 shown in FIG. 1 is provided directly below the scanning point p. The scanner device 3 is unitized so as to scan an image of the original document fed automatically and sequentially by the ADF 2. In the scanner device 3, a light source 3*b*, a plurality of mirrors 3*c*, a focusing lens 3*d* and a Charge Coupled Device (CCD) 3*e* are provided in a unit housing 3*a*. Further, the light source 3*b* is formed of a fluorescent light or a cold cathode tube. In the scanner device 3, irradiated light from the light source 3*b* is reflected by the original document passing the scanning point p. The reflected light is repeatedly reflected by the mirrors 3*c* and focused by the focusing lens 3*d*. Then, the light enters into the CCD 3*e* and an image is formed. In the CCD 3*e*, image information is converted sequentially into an electric signal and output as a digital signal.

The printing unit 4 is formed of an electrophotographic printing device. The printing unit 4 includes a photoconductive drum 6, a charger 7, an optical (LED or laser) writing head 8, a developing unit 9, a transfer unit 10 and a fuser 11. At the downstream of the fuser 11, a pair of discharge rollers 12 and a discharge tray 13 are provided. In the electrophotographic printing device, image information scanned by the scanner device 3 or image information transmitted from a remote terminal such as a facsimile machine or a personal computer is written as optical information by the optical writing head 8 on the surface of the photoconductive drum 6 charged uniformly by the charger 7. An electrostatic latent image based on the optical information is formed on the surface of the photoconductive drum 6. The electrostatic latent image is developed by the developing unit 9. Then, at the transfer unit 10, the electrostatic latent image is transferred sequentially as a toner image onto recording paper which has been transported through a curved transportation path 14 and introduced by a pair of resist rollers 15. The toner image transferred onto the recording paper is fused as a permanent image by the fuser 11. The recording paper on which the permanent image is formed is discharged and stacked onto the discharge tray 13 by the pair of the discharge rollers 12. Further, a detail structure of the printing unit 4 will be described later.

The paper feed unit 5 includes two recording paper cassettes 5*a* provided vertically. At a front end part of the recording paper cassettes 5*a*, paper feed rollers (semicircular rollers) 5*b* are provided. The paper feed rollers 5*b* are pressed against a leading edge of an uppermost sheet of recording papers P accommodated in the recording paper cassettes 5*a*. Accompanying a rotation of the paper feed rollers 5*b*, the recording papers P accommodated in the recording paper cassette 5*a* are fed one sheet at a time from an uppermost layer. In each of the recording paper cassettes 5*a*, a pressing plate 5*c* and a regulatory plate 5*d* are provided. The pressing plate 5*c* is urged upward by a spring or the like (not shown). The regulatory plate 5*d* restricts a trailing edge of the recording papers. A position of the regulatory plate 5*d* can be adjusted. Accordingly, even when the volume of the recording papers P in the recording paper cassette 5*a* changes, the uppermost layer of the recording papers P is always maintained at a position to be fed by the paper feed rollers 5*b*. The recording papers P are accommodated at an appropriate position according to the size of the paper. Although a description and a drawing will be omitted, supplementary members necessary for the recording paper cassette are also provided. Further, below the lower recording paper cassette 5*a*, an optional cassette (not shown) can be provided to form a multi-cassettes system having three or more cassettes. Alternatively, a single cassette system can be used.

Separating claws (snubbers) 5*e* are mounted on an edge of the recording paper cassettes 5*a* at a side from where the recording papers are fed out. The separating claws 5*e* separate the stacked recording papers P one sheet at a time accompanying the rotation of the paper feed rollers 5*b*. Another member can be adopted in place of the separating claws 5*e*. For example, a friction separating pad method can be adopted. Next to the separating claws 5*e*, guide members 5*f* which can be inclined front and back are provided. Furthermore, behind the guide members 5*f*, openable and closable jam access covers 5*h* are provided across paper feeding paths 5*g* of the recording papers fed from the lower cassette 5*a*. Press rollers 16*a* are provided facing transportation rollers 16 and mounted on an inner side of the jam access covers 5*h*. The transportation rollers 16 are provided in a body of a main frame of the image forming device 1. When the jam access covers 5*h* are opened, the transportation rollers 16 and the press rollers 16*a* are separated from one another. Accordingly, recording paper jammed in proximity to the jam access covers 5*h* can be removed.

The optical writing head 8 is mounted on an inner surface (lower surface) of a maintenance intermediate cover 17. As described above, when the ADF 2 or the like is opened, the upper surface of the printing unit 4 is opened and the upper surface of the cover 17 is exposed. The cover 17 can be opened and closed vertically with a hinge pin 17*a* as the center. The cover 17 is urged upward by a torsion spring 17*b*. However, the cover 17 is maintained under a closed state as shown in the drawing at all times by a lock mechanism (not shown). When replacing a photoconductive drum unit or a developing unit to be described later or when carrying out maintenance work of jammed paper or the like, after the ADF 2 or the like is opened, by operating a knob 17*c* which also functions to unlock the locked state, the cover 17 is opened. Accordingly, the maintenance work can be performed inside the image forming device 1. Then, when the cover 17 is closed and the image forming device 1 returns to a normal usage condition, the optical writing head 8 is positioned at a proper relative position with respect to the photoconductive drum 6 by a positioning structure of each embodiment to be described below.

First Embodiment

FIG. 2 and FIG. 3 show an embodiment in which an optical writing head is positioned with a drum shaft of a photoconductive drum as a standard. That is, the photoconductive drum 6 includes a hollow cylindrical drum body 6*a* and insulative (synthetic resin) flange members 6*b*. An outer circumferential surface of the drum body 6*a* is a photoconductive layer. The flange members 6*b* are fixed on both ends of the drum body 6*a*. The drum body 6*a* is supported rotatably on a drum shaft 6*c* via the flange members 6*b*. Furthermore, contact terminals 6*d* are fixed on an inner surface of the drum body 6*a* and on the flange members 6*b*. In addition, the contact terminals 6*d* make contact with the circumferential surface of the drum shaft 6*c*. A gear 6*e* is formed on the outer circumferential surface of one of the flange members 6*b*.

The photoconductive drum 6 is supported via the drum shaft 6*c* in a box-shaped unit housing 18 formed of synthetic resins. The flange members 6*b* and the drum body 6*a* are provided integrally and rotatably on the drum shaft 6*c* fixed on the unit housing 18. In the unit housing 18, the charger (a brush charger, a roller charger or the like) 7 and a memory erasing brush (or a toner cleaner) 7*a* are provided to constitute a drum unit. The memory erasing brush 7*a* scatters the toner remaining on the surface of the drum body 6*a*. The drum unit is provided removably at a prescribed position of the main frame of the image forming device 1. In this case, positioning slits 19*a* are formed by cutting off a metal frame 19 which constitutes the body of the main frame of the image forming device 1. The drum shaft 6*c* is fit and held in the positioning slits 19*a*. Accordingly, the drum unit is provided under a positioned state.

Under the state in which the drum unit is provided, the gear 6*e* is engaged with a drive transmitting gear (not shown) in the image forming device 1. The circumferential surface of the drum body 6*a* makes contact with the transfer unit (the transfer roller) 10 provided in the image forming device 1. The inner surface of the drum body 6*a* is electrically conducted with the grounded frame 19 via the contact terminals 6*d* and the drum shaft 6*c*. The developing unit 9 is also unitized by including a developing roller 9*a* or the like. The developing unit is provided integrally with the drum unit (can be separated from one another) or provided independently at a prescribed position in the image forming device 1. Under this state, the drum body 6*a* and the developing roller 9*a* are positioned in proximity to one another or in contact with one another.

The optical writing head 8 includes a box-shaped housing 8*a*, a plurality of LED element arrays 8*b* and a lens array 8*c*. The housing 8*a* is fixed on the lower surface of the cover 17. The LED element arrays 8*b* are arranged along a longitudinal direction (a direction orthogonal to a paper transportation direction) inside the housing 8*a*. The lens array 8*c* is provided at a light outlet. Positioning pins 8*d* facing downward are mounted at both end parts of the housing 8*a* in the longitudinal direction. Positioning concave parts 6*f* are formed on both end parts of the drum shaft 6*c*. When the cover 17 is closed, tip ends of the positioning pins 8*d* are caught in the positioning concave parts 6*f*. In this case, as described above, the drum shaft 6*c* is positioned at the proper relative position with respect to the main frame of the image forming device 1 by the positioning slits 19*a*. The photoconductive drum 6 is assembled to be located at the proper positional relationship with respect to the drum shaft 6*c*. Therefore, even when the cover 17 is deformed slightly and the hinge pin 17*a* is distorted, the optical writing head 8 can be positioned appropriately at the proper relative position with respect to the photoconductive drum 6 by the tip ends of the positioning pins 8*d* being caught in the positioning concave parts 6*f*. In particular, such a positioning is carried out by the frame 19, the drum shaft 6*c* and the positioning pins 8*d* which are rigid and have small processing error. Therefore, a highly accurate positioning can be carried out.

Under the state in which the optical writing head 8 is positioned as described above, the lens array 8*c* faces a light entrance 18*a* opened on an upper surface of a drum unit housing 18. Therefore, the light from the LED element array 8*b* is irradiated on the surface of the drum body 6*a* via the lens array 8*c*. Thus, when the light based on the image information is irradiated by the optical writing head 8 on the surface of the drum body 6*a* charged uniformly by the charger 7, an electric charge of a part receiving the light flows from the inner surface of the drum body 6*a* via the contact terminals 6*d*, the drum shaft 6*c* and the frame 19 onto ground. Accompanying the rotation of the drum body 6*a*, an electrostatic latent image based on the image information is formed sequentially on the surface of the drum body 6*a*. The electrostatic latent image is developed as the toner image by the developing unit 9 accompanying the rotation of the photoconductive drum 6 around the drum shaft 6*c*. Then, the toner image is transferred onto the recording paper imported between the photoconductive drum 6 and a transfer roller 10. Subsequently, the toner image is fused onto the recording paper as a permanent image by the fuser 11 shown in FIG. 1.

Second Embodiment

FIG. 4 shows an embodiment in which an optical writing head is positioned with respect to a paper guide member formed in proximity to a part where a photoconductive drum is provided. In the front and the back of the transfer unit 10, a paper guide member 20 leading from the pair of the resist rollers 15 to the fuser 11 (both shown in FIG. 1) is provided. The paper guide member 20 is formed of a synthetic resin molding or a metal plate member. The paper guide member 20 is integrally fixed on the frame 19 via attachment bases 20*a* at both sides of the paper guide member 20 in a width direction. Positioning concave parts 20*b* are formed on an upper surface of the attachment bases 20*a*. When the cover 17 is closed, as described above, the tip ends of the positioning pins 8*d* of the optical writing head 8 fixed on the lower surface of the cover 17 are caught in the positioning concave parts 20*b*.

In this case, since the paper guide member 20 is fixed integrally with the frame 19, the paper guide member 20 is provided appropriately at the proper relative position with respect to the main frame of the image forming device 1. Meanwhile, since the photoconductive drum 6 is held by the positioning slits 19*a* of the frame 19 via the drum shaft 6*c*, the photoconductive drum 6 is also positioned appropriately at the proper relative position. Thus, the proper relative positional relationship of the optical writing head 8 positioned on the paper guide member 20 via the positioning concave parts 20*b* and the photoconductive drum 6 can be maintained appropriately. As a result, the recording paper transported along the paper guide member 20 and the writing position of the image information by the optical writing head 8 are difficult to be displaced. Consequently, an image with a high image quality can be formed. Further, other structures are the same as the first embodiment. Therefore, for the common parts, the same reference numerals are applied and the description will be omitted.

Third Embodiment

FIG. 5 shows an embodiment in which an optical writing head is positioned by contacting a lens array directly against a surface of a housing of a photoconductive drum unit. That is, a concave part 18*b* is formed as a leveled part on the upper surface of the drum unit housing 18. The concave part 18*b* includes the light entrance 18*a*. An outer shape of the concave part 18*b* is formed slightly larger than the outer shape of the lens array 8*c*. In this case, when the cover 17 is closed, the lens array 8*c* protruding from the lower end surface of the optical writing head 8 makes contact with the concave part 18*b* and is caught in the concave part 18*b*. Therefore, the optical writing head 8 is positioned in the height direction and the width direction with respect to the concave part 18*b* (including the transportation direction of the recording paper). Further, a shock absorber can be provided at the contacting part. Since the concave part 18*b* as shown in FIG. 5 can position the optical writing head 8 not only in the height direction but also in the width direction, such a concave part 18*b* is adopted most preferably. However, in case only the positioning in the height direction is demanded, without forming such a concave part 18*b*, the lens array 8*a* can be provided to make direct contact with the upper surface of the drum unit housing 18.

In case of the third embodiment, the lens array 8*c* is positioned directly with respect to the drum unit housing 18. Therefore, the relative positioning of the optical writing head 8 with respect to the photoconductive drum 6 can be carried out highly accurately. In addition, since the positioning pins 8*d* as described above are not required to be provided newly, a commercially available LED unit can be used as it is. As a result, the number of components and the number of assembling steps can be reduced. Further, other structures are the same as the other embodiments. Therefore, for the common parts, the same reference numerals are applied and the description has been omitted.

In the above-described embodiments, the LED head is adopted as the optical writing head 8. However, the present invention can be applied also to a positioning mechanism of a laser head. Moreover, the image forming device can be an image forming device having a Flat Bed Scanner (FBS) or other copy machine or a printer.

The invention claimed is:

1. An image forming device, comprising:

a main frame having a body;

a photoconductive drum which is provided removably in the main frame, an optical writing head which is positioned relatively with respect to the photoconductive drum and includes a lens array at an output side of the optical writing head; and a housing of a photoconductive drum unit which rotatably supports the photoconductive drum and is positioned and supported on the body of the main frame, wherein by contacting the lens array directly against a surface of the housing of the photoconductive drum unit, the optical writing head is positioned relatively with respect to the photoconductive drum, and wherein a shock absorbing member is provided between the lens array and a contact part where the lens array makes contact with the surface of the housing of the photoconductive drum unit.

2. The image forming device according to claim 1, wherein a concave part having an outer shape approximately the same as an outer shape of the lens array is formed on a surface of the housing of the photoconductive drum unit where the lens array makes contact.

3. The image forming device according to claim 1, wherein the optical writing head is mounted on an inner surface of an intermediate cover which can be opened and closed for maintenance work.

4. The image forming device according to claim 3, wherein the intermediate cover can be opened and closed vertically with a hinge pin as a center and is urged upward by a spring.

5. The image forming device according to claim 1, wherein the photoconductive drum includes a hollow cylindrical drum body which an outer circumferential surface is formed as a photoconductive layer, and insulative flange members fixed on both end parts of the drum body, and the drum body is supported rotatably on the drum shaft via the insulative flange members.

6. The image forming device according to claim 1, wherein the photoconductive drum is supported via the drum shaft in a box-shaped unit housing formed of synthetic resins.

* * * * *